United States Patent [19]

Eng

[11] 4,342,460

[45] Aug. 3, 1982

[54] GASKET MEANS FOR ELECTROLYTIC CELL ASSEMBLY

[75] Inventor: Jeffrey D. Eng, North Vancouver, Canada

[73] Assignee: Hooker Chemicals & Plastics Corp., Niagara Falls, N.Y.

[21] Appl. No.: 891,978

[22] Filed: Mar. 30, 1978

[51] Int. Cl.[3] ..... C25B 9/00; F16J 15/54

[52] U.S. Cl. ..... 277/1; 204/279; 277/205

[58] Field of Search ..... 277/206, 166, 165, 207 A, 277/1, 205; 204/279, 253

[56] References Cited

U.S. PATENT DOCUMENTS

| | | | |
|---|---|---|---|
| 3,052,476 | 9/1962 | Workman | 277/206 |
| 3,174,761 | 3/1965 | Workman | 277/206 |
| 3,507,505 | 4/1970 | Muhlner et al. | 277/207 A |
| 3,592,491 | 7/1971 | Glover | 277/206 |
| 4,026,782 | 5/1977 | Bouy | 204/279 |
| 4,175,025 | 11/1979 | Creamer | 204/279 |
| 4,207,165 | 6/1980 | Mose et al. | 204/279 |
| 4,214,969 | 7/1980 | Lawrence | 204/279 |

*Primary Examiner*—Robert I. Smith

*Attorney, Agent, or Firm*—James F. Tao; Howard M. Ellis

[57] ABSTRACT

In filter press electrolytic cell assemblies, gasketing materials are frequently used for sealing the cell contents between individual frames. An improved design of gasket is disclosed, having a bulb profile at one surface with a hollow or indented profile on the opposite. Use of this specific profile gasket, positioned in properly molded or machined sealing grooves in the mating surfaces of electrolytic cell frame members, permits repeated disassembly and reassembly of cell frame components without leakage of electrolytic fluids between cell compartments, or leakage from cell interior to exterior.

10 Claims, 3 Drawing Figures

GASKET MEANS FOR ELECTROLYTIC CELL ASSEMBLY

BACKGROUND OF THE INVENTION

The concept of this invention relates to a combination of electrolytic cell frames for use in a filter press type of electrolytic apparatus, such as those with a separating web between them to provide a liquid impermeable separator between anode and cathode compartments of an electrolytic apparatus.

Electrolytic apparatuses incorporating cells containing either monopolar or bipolar electrodes are useful for the manufacture of various chemical materials, including chlorine, caustic, and chlorate, and are well known. It is also known to make such cells of a filter press assembly type, wherein a plurality of frames are held together by longitudinally compressive forces such as those applied at the ends of a filter press. In such apparatuses, electric current is passed from an anode through the electrolyte to a cathode, and then from such cathode to an adjacent anode, and such operation is repeated throughout the length of the apparatus. It is important that each cell be physically separated from the next so that electrolytic fluids in them will not be transferred between them. In recent years, as well as using steel and metals as materials of construction for electrolytic cell body and wall parts, synthetic organic polymeric materials have been utilized, such as filled polypropylene. Use of synthetic organic polymeric materials, such as polypropylene, allows the molding of electrolytic compartment frames and other cell parts, and accordingly permits the manufacture by relative inexpensive methods of monopolar or bipolar electrolytic apparatuses of filter press type. Also, because of the generally good resistance of polypropylene and equivalent and similar moldable polymeric materials to various types of electrolytes, such as hydrochloric acid, brine, aqueous caustic solutions, and aqueous chlorine solutions, such frames resist chemical attack during use.

One disadvantage found with such molded polymeric frame members is that with the present state of knowledge in the art it is very difficult to accurately mold larger electrolyte compartment frames which incorporate a separating web. Also, due to different thicknesses of material involved, it has been found that areas of strain exist where such different thicknesses join, and because such strains vary even between different molded articles pulled from the same mold, modifications of mold designs do not readily solve the problem. Further, and also as a result of the different thicknesses of the frame and separating web materials where they join in an integral structure, it has been found that during heating and cooling of an electrolytic cell the differential expansion experienced (with the thinner part being heated or cooled more rapidly than the thicker part) creates strains which, especially in larger pieces, can cause minor distortions and inefficiency of cell operation at best, and warping, cracking and fracture of parts at worst. To overcome these problems, another has suggested, in application Ser. No. 866,423, assigned to the assignee of the present application, the use of a separate and distinct separating web, which obviates molding problems due to increasing sizes of the structures involved to produce electrolytic cells of greater capacities, and at the same time eliminates strains at points of connection or joinder of the web and frame. Also, strains are not created in such structures because of expansions of some of the parts thereof, especially differential expansions upon heating and cooling of the electrolytic apparatus.

In both of the filter press apparatuses described above, it has been found advantageous to provide sealing means, i.e. gaskets, between individual cell members, so as to prevent leakage of electrolytic materials. In past filter press cell designs, utilizing membrane separators, a flat gasket was used for sealing the cell contents. Because the gasket was flat, mating surfaces required close tolerances to effect an efficient seal. Further, flat gaskets were unable to retain their original shape due to cold flow or extrusion under compression, resulting in permanent distortion or compression set when the gasket was squeezed and became over stressed. In addition, when the gaskets were used in direct contact with a separating membrane, the membrane often would tear due to lateral outward movement of the gasket when the gasket was compressed against the membrane. These problems have been overcome in the present invention, by providing a gasket having a bulb profile, the size of the bulb being sufficiently great to be compatible with the larger tolerances desired. Placing this specifically profiled gasket into a groove in the face of a frame such that only the bulb portion stands above the surface of the frame, and further profiling the gasket such that a void fraction always exists in the groove when the bulb is compressed, insures that the gasket is never over compressed or over stressed to the point of permanent deformation. Further, when the gasket of the present invention is compressed, there is no lateral outward movement to tear a contacting membrane, since the specific gasket profile allows only a compressive movement of the bulb portion of the gasket into the void volume thereof.

BRIEF DESCRIPTION OF THE DRAWINGS

The invention will be more fully understood and further objects and advantages thereof will become apparent when reference is made to the following detailed descriptions of preferred embodiments of the invention and the accompanying drawings in which:

In FIG. 1, anode compartment frame 11 and cathode compartment frame 13 are shown, with intermediate web assembly 15 illustrated in place there between. As is seen from the drawing, web assembly 15, shown primarily as web 46, is sandwiched between anode compartment frame 11 and cathode compartment frame 13. Resilient gasket 49, which fits into a continuous accommodating recess 50 in the cathode compartment frame and "encircles" the web 46, projects from such recess prior to compression. In the assembly of the cathode compartment frame, web and anode compartment frame as shown, the gasket is substantially flattened under compression force and contacts the major face 53 of web 46 over substantially the entire width of the accommodating recess, 50 resulting in a sealed, fluid-tight relationship between the frame and web. A matching gasket 55 is provided in a similarly accommodating recess 52 in the anode compartment frame 11. Thus, gasket 55 also holds the web 46 in liquid-tight and fluid-tight contact with anode compartment frame 11. In each instance, a void volume, or unoccupied space, 51 and 54, respectively, remains after compression of the gasket in the recess. Additionally, gasket 59, in an accommodating recess 60 in the anode compartment frame, prevents the escape of gaseous products of electrolysis from the gas headers. Upon compression, void volume 61 remains in the recess. A corresponding recess and gasket are utilized in conjunction with the cathode compartment frame.

In the assembly illustrated, the electrode compartment frames measure in excess of 1 by 2 meters, with the longest axis being horizontal, and with the other of the two major axes being vertical. As illustrated in FIG. 1, a recess, 63, is provided at the vertical end of web 15, said recess 63 being formed by the walls 73 and 75 of corresponding recesses in the mentioned frames, present to accommodate web 15. Although recess 63 is illustrated at the top of the web 15, a corresponding recess may also be and is sometimes provided adjacent to the bottom of such web, so as to allow expansion of the web in a vertical direction without strain on the assembly. Such a recess also is formed along the vertical edge of web 15, so as to permit expansion in a horizontal direction. However, it has been found that provision of the recess, or room for expansion, at the top and along one vertical edge only, is suitable for assemblies of the size and character herein described, and often, due to its weight, the web will settle to the bottom of any recess provided at the bottom of the frame members. Alternatively, frame members having integral webs may be utilized, as illustrated in FIG. 3.

It is to be understood that for sake of simplicity and understanding, all details of the frame and web assembly are not illustrated. For example, FIG. 1 does not show all of the details of the framing members and web because it is considered that most of these will be evident to those of skill in the art, and relate primarily to fitting together of various cell parts, and not to the primary aspects of the invention. One of skill in the art will recognize that catholyte compartment framing member 13, as illustrated, is clearly of a structure similar to that of anode compartment frame 11. Not illustrated is the membrane, which may be held to the cathode compartment frame 13, by suitable means not shown, and the next adjacent anode frame 11. Also not shown are electrodes and electrode connecting members, electrode conductor bars, bolts, collars, etc.

Figure 2:
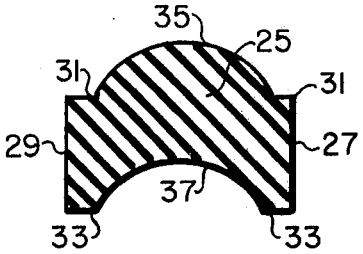
FIG. 2 is a section of the resilient gasket utilized in the present invention, in its normal or non-compressed configuration.

In FIG. 2, there is shown a profile of a gasket of the present invention. The dimensions of this gasket are selected so as to conform to the recess in anode frame 11 and cathode frame 13. While gaskets of different dimension may suitably be used for web sealing gaskets 49, 55 and header sealing gasket 59, for convenience and economy, a single size gasket is normally employed. Gasket 25 comprises side walls 27 and 29, and top and bottom surfaces having top shoulders 31 and bottom shoulders 33, respectively. It is understood that the dimensions of side walls 27 and 29 will correspond approximately to the depth of the receiving recesses or grooves in anode frame 11 and cathode frame 13, while the width of said gasket, i.e. the distance between said side walls 27 and 29, shall correspond to the width of said recess. It is also to be understood that bottom shoulders 33 are placed within the groove or recess, so as to be located at the "bottom most" portion of said recess. The top surface of the gasket is provided with a protrusion or bulb 35, while the bottom surface, i.e. that surface placed within the frame recess, is grooved or cut away to provide a void area 37. The dimensions of said bulb or crown 35 and said void area 37 are such that void area 37 equals or exceeds the crown area 35. Thus, upon compression of the gasket material 25, from a direction normal to the crown area 35, a sufficient void space 37 is available to allow deflection of surface 35 to a position even with top shoulders 31, while a void area still remains. The lengthwise dimension of gasket 25, i.e. the dimension normal to the plane of the drawing, is selected to coincide with the desired length for the specific gasketing utility envisioned, and the length of recess in which the gasket is to be placed.

Figure 3:
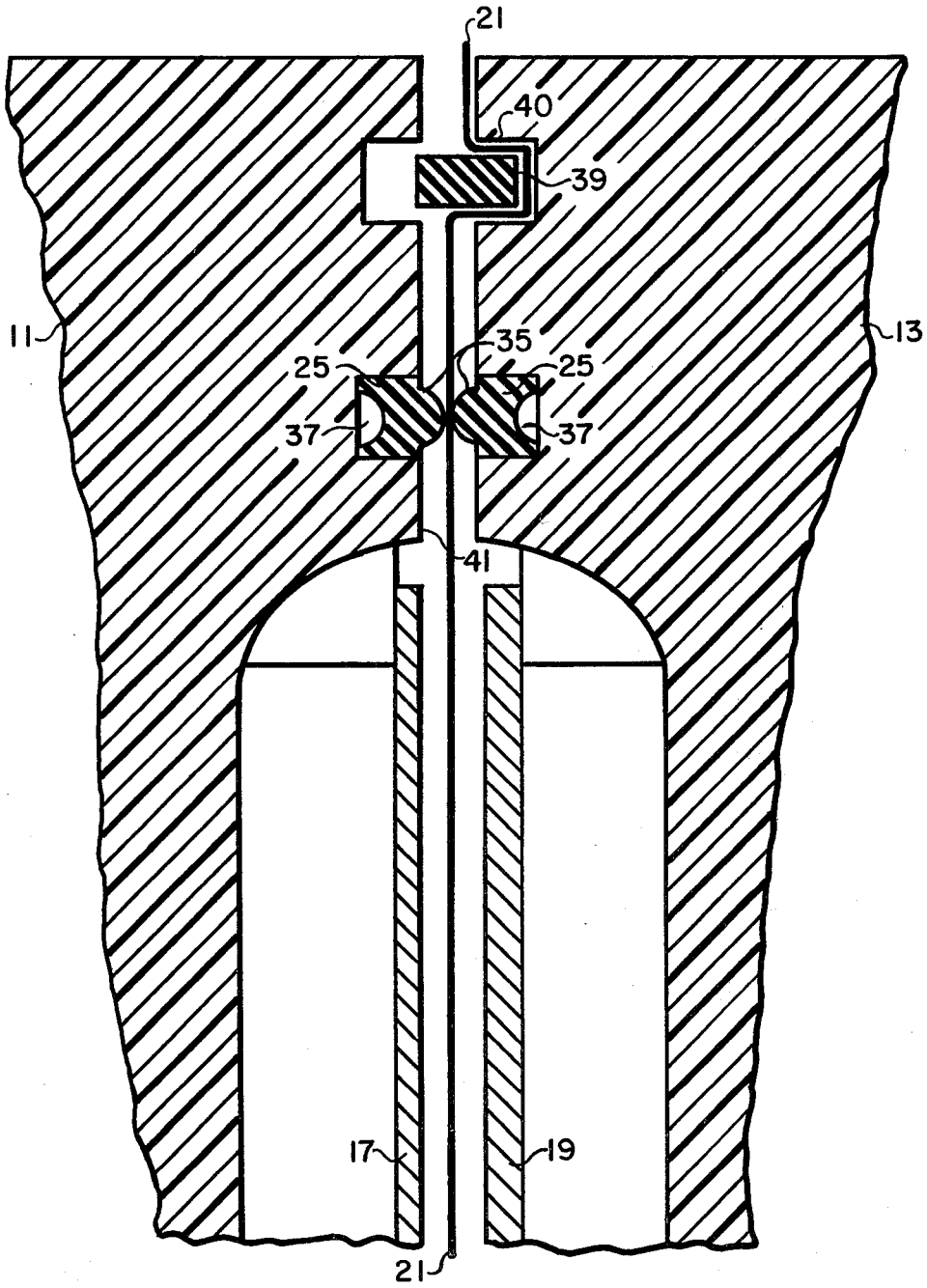
FIG. 3 represents a profile of a chlor-alkali membrane cell, utilizing the gasket material of the present invention in conjunction with frames having integral webs.

In FIG. 3, anode frame 11 is shown with anode 17, appropriately mounted therein. Cathode compartment frame member 13 is illustrated with cathode member 19 and membrane 21, secured by frame members 11 and 13. Appropriate mounting means for anode 17 and cathode 19 are not illustrated, for clarity. In this embodiment, membrane 21 is positioned between frames 11 and 13, and securely held in place by opposing gaskets 25, mounted in recesses in both the anode and cathode compartment frame members 11 and 13. Illustrated are gaskets 25, having crown portions 35 extending beyond the surfaces of the recesses or grooves in the frame members, and cavities 37 in the opposite faces of said gaskets. When compressive force is applied to anode frame 11 and cathode frame 13, forcing them together, crown portions 35 come into contact with opposite sides of membrane 21, and are compressed into the grooves or recesses in the frame members, thus occupying the void spaces created by cavities 37. The membrane may be further secured by any suitable fashion to either the anode or cathode frame. This is illustrated in FIG. 3 by a plastic plug 39, which holds membrane 21 in place in securing recess 40. It is understood, however, that membrane 21 may be also secured to either anode frame 11 or cathode frame 13 in any other suitable fashion, such as by bolting, glueing, self-tapping screws, or otherwise.

It is to be understood that while such gaskets may be formed by any convenient manufacturing technique, extrusion is considered the most feasible. The material of the gasket may suitably be neoprene, natural rubber, or other synthetic or organic elastomeric materials. At present, the preferred gasketing material is an ethylene propylene rubber such as EPDM rubber, may be obtained. The gasket of the present invention is designed so that the elastomer is deformed, and the seal is effected by the inherent "memory" or resiliency of the elastomer as it attempts to return to its original molded shape. The ratio of recess volume to gasket volume is extremely important since it assures that the elastomer will not be overstressed in the compressed state, and allows for the thermal expansion of the gasket material, as well as compensating for the chemical effect of various fluids on the elastomeric material. It has been found that the ratio of the cross-sectional area of the gasket to the cross-sectional area of the groove or recess in which the gasket fits, should be from 0.80 to about 1.00. Similarly, it has been found advantageous to proportion the gasket in such a manner that the ratio of the cross-section of the crown, or raised area thereof, to the void area or cavity thereof is from about 0.10 to 1.00. Utilizing gaskets as defined by the above ratios, one is able to devise a system capable of sealing a cell under relatively low compressive force, without requiring close tolerances such as those necessary when utilizing metal to metal or plastic to plastic sealing mechanisms. The specific design inherently overcomes the lack of control often experienced in the extrusion of plastics or elastomeric gasket materials. Thus, the protruding regions of the gaskets being in mating relationship, either to a facing flat surface or to an opposing gasket of similar configuration, are compressed in such a manner as to occupy the void space, rather than "rolling off" or twisting.

Figure 1:
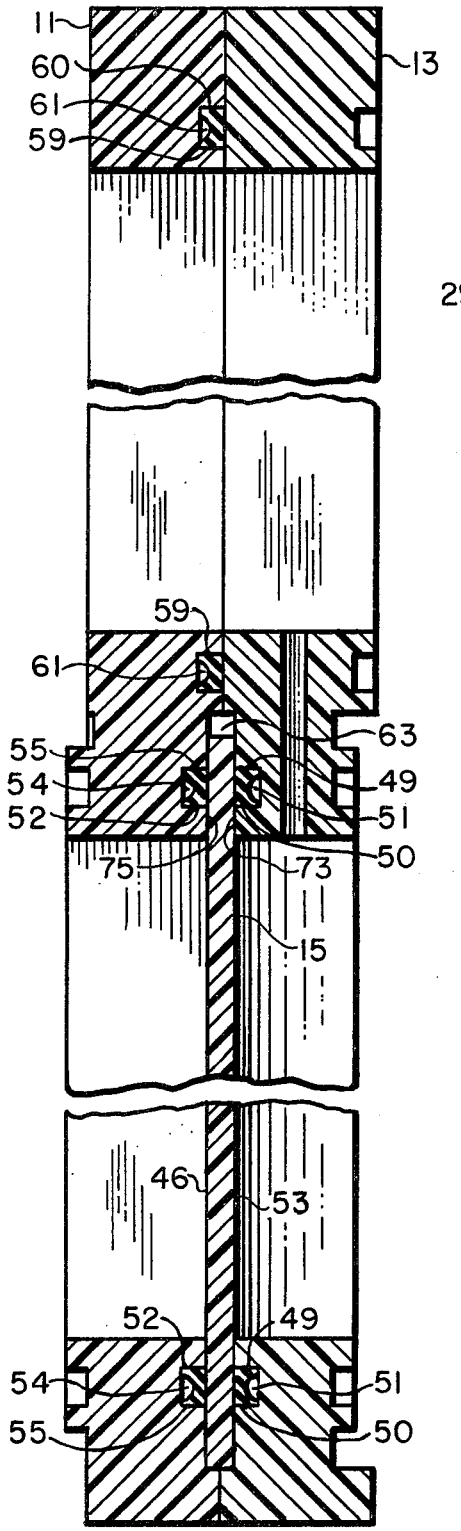
FIG. 1 is a vertical sectional view of an assembly of electrode compartment frames with an intermediate web assembly, demonstrating various electrolytic cell parts held to the web and frame, and illustrating the gasket of the present invention in compressed form.

It is noted that when the gasket is utilized to seal two frame members, as in the area of a gas header, wherein cell contents are to be retained, the raised gasket portion may contact a flat surface, as illustrated in FIG. 1. However, in some situations, wherein a membrane is mounted between anode and cathode but such materials as silicone rubbers, nitrile rubbers, butyl rubbers, chlorosulfonated polyethylenes, fluorosilicones, fluorocarbon rubbers, polysulfide rubbers, and other types of known gasketing elastomers may be utilized. It is preferred that the gasket material have a hardness resulting in a Durometer reading of from 30 to 90, and more preferably between 50 and 70. These gaskets may be suitably be formed in continuous "ring" or other suitable preshaped form to be accommodated by the appropriate recesses in the apparatus frames, but it is also within the scope of the invention to prepare the gasket in continuous form, for insertion in the appropriate recesses with the opposed ends in butting or overlapping relationship, or spliced together and heat treated to form a continuous member.

While dimensions of the gasket material are selected so as to correspond to the recesses in which the gaskets are to be placed, approximate dimensions may be from about $\frac{1}{4}$ inch to about $1\frac{1}{2}$ inch width, from about $\frac{1}{8}$ to about 1 inch shoulder to shoulder height, with a bulb or crown section protruding approximately 1/32 to about $\frac{1}{2}$ inch above the shoulders, and the cavity portion extending from about 3/64 to about $\frac{3}{4}$ inch into the gasket. The crown portion and cavity portion may preferably be arcuate, or, alternativey may be rectangular or otherwise formed. The protruding crown portion may be made as large as desired or required. One advantage of the present gasket design is that the design allows the gasket material not to be compressed as greatly as in a flat surfaced gasket, or "o-ring" type of gasket. This in turn permits greater compressive force, with less danger of overstress, i.e. breakdown or flattening of the gasket to the point of extrusion or compression set.

By selecting the proper ratio between the volume of the void area and the volume of the crown, controlled gasket compression frames directly, the gasket materials may be placed in opposition to each other as in FIG. 3. In such situations, the two raised portions of the gasket material are opposed, and under compressive force move perpendicularly to the surface of the membrane in a direction toward the void space, thus not displacing the membrane laterally. Whereas a flat gasket, or o-ring gasket, under compression, can cause lateral movement of the membrane, or can itself move laterally, thus causing tearing of the membrane, the gasket of the present invention has been found to avoid membrane tearing. The specific configuration of the gasket of the present invention is utilized to avoid twisting or "roll-off" of mating gasket surfaces, thus avoiding pulling, stretching, and/or tearing of the membrane. Further, if mating gasket surfaces are somewhat displaced, the bulb-like protrusion permits a tight compressive seal, holding a membrane between the misaligned gasket material. Thus, the membrane may occupy a curvilinear or "S" shaped position between two curved bulb like or protruding gasket faces.

A gasket in accordance with the present invention was prepared of EPDM rubber, and extruded to have a shape as illustrated in FIG. 2. The dimensions of the gasket were as follows: the height of the side walls, 27 and 29, was $\frac{3}{8}$ inch; the width of the shoulders, 31 and 33, was $\frac{1}{8}$ inch; the overall width of the gasket, from side wall to side wall, was $\frac{3}{4}$ inch. Thus, the width each of the protruding bulb like portion and the cavity was $\frac{1}{2}$ inch; the bulb portion, 35, extended $\frac{1}{4}$ inch above shoulder 31, while cavity 37 reached a depth of 0.140 inches from shoulder 33 toward the center of the gasket. Both the protruding portion and the cavity were arcuate in shape, although other configurations, such as triangular, truncated, or even irregular shapes, are suitable. This gasket was utilized in a prototype membrane cell as illustrated in FIG. 1. The dimensions of the recesses in which the gasket was placed, were $\frac{3}{4}$ inch wide by $\frac{3}{8}$ inch deep. The cell was closed, and energized, and utilized to produce chlorine and caustic for a period of over 120 days. The cell operated with no leakage even though the gaskets were decompressed and recompressed a number of times during the span for test purposes. No damage was observed on the membrane surfaces because of the gaskets.

In a second test, a ten day heat cycle test was conducted, utilizing a full sized membrane between anode and cathode frame members. In this test, a single sheet membrane was positioned between two test plates, without an electrode, which were secured with six pipe clamps. The test plates comprised anode frame and cathode frame members, each having a recess to receive a gasket as set forth above. This assembly was filled with water, placed in a water tank, submerged, and heat cycled for ten days, whereby the temperature of the water cycled from about 85° C. to about 25° C. Upon conclusion of the test the tank was drained and the assembly removed, upon which it was found to still be full of water, and evidencing no leakage, indicating that an adequate clamping pressure had been maintained. After disassembly, it was found that the top and bottom opposing gaskets had been exactly matched, but that the two sides were misaligned by approximately $\frac{1}{8}$ inch, causing the raised surfaces of the gasket material to shear past each other. However, it was noted that the membrane material sustained no evidence of damage or deformation due to compression or gasket creep.

The invention has been described with respect to various illustration and embodiments thereof, but it is not to be limited to these because it is evident that one of skill in the art, with the present specification before him would be able to utilize substitutes and equivalents without departing from the spirit of the invention.

What is claimed is:

1. An apparatus comprising in combination a plurality of electrolytic cell frames and gasket means for sealing opposing mating surfaces, the cell frames having longitudinal recesses of generally rectangular cross section for accommodating said gasket, the gasket comprising parallel side walls, bottom shoulders, an indented, arched cavity between the bottom shoulders, top shoulders and when in a relaxed state an elevated, bulb shaped bearing surface between said top shoulders, the dimensions of the indented cavity being equal to or greater than the dimensions of the elevated bearing surface, the parallel walls and shoulders of the gasket conforming in shape to the generally rectangular configuration of the recesses, said apparatus being further characterized by the absence of lateral movement of said gasket when compressed against opposing surfaces.

2. The apparatus of claim 1 wherein the ratio of the cross section of the elevated bearing surface to the indented cavity of the gasket is from about 0.10 to 1.00.

3. The apparatus of claim 2 wherein the ratio of the cross sectional area of the gasket to the cross sectional area of the recess in which the gasket fits is about 0.80 to about 1.0.

4. The apparatus of claim 1 wherein the gasket is fabricated from an elastomeric organic polymeric material.

5. The apparatus of claim 5 wherein the polymeric material comprises EPDM rubber.

6. A process of sealing a filter press type electrolytic cell which comprises (a) inserting a gasket into individual electrolytic cell frames, said frames having longitudinal recesses of generally rectangular cross section for accommodating said gasket, the gasket comprising parallel side walls, bottom shoulders, an indented, arched cavity between the bottom shoulders, top shoulders and when in a relaxed state an elevated, bulb shaped bearing surface between said top shoulders, the dimensions of the indented cavity being equal to or greater than the dimensions of the elevated bearing surface, the parallel walls and shoulders of the gasket conforming in shape to the generally rectangular configuration of the recesses, and (b) assembling a plurality of the individual gasketed cell frames into a filter press configuration wherein the frames are held together by compressive forces without causing lateral movement of the gasket.

7. The process of claim 6 wherein the ratio of the cross section of the elevated bearing surface to the indented cavity of the gasket is from about 0.10 to 1.00.

8. The process of claim 7 wherein the ratio of the cross sectional area of the gasket to the cross sectional area of the recess in which the gasket fits is about 0.80 to about 1.0.

9. The process of claim 6 wherein the gasket is fabricated from an elastomeric organic polymeric material.

10. The process of claim 9 wherein the polymeric material is EPDM rubber.

* * * * *